US008406677B2

(12) United States Patent
Kondo

(10) Patent No.: US 8,406,677 B2
(45) Date of Patent: Mar. 26, 2013

(54) IMAGE FORMING DEVICE THAT REDUCES CONSUMPTION OF TONER USED FOR NON-PRINTING PURPOSE

(75) Inventor: Masao Kondo, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 310 days.

(21) Appl. No.: 12/726,377

(22) Filed: Mar. 18, 2010

(65) Prior Publication Data

US 2010/0239284 A1 Sep. 23, 2010

(30) Foreign Application Priority Data

Mar. 23, 2009 (JP) ..... 2009-070122

(51) Int. Cl.
*G03G 21/00* (2006.01)

(52) U.S. Cl. ..... 399/346; 399/71; 399/43

(58) Field of Classification Search ..... 399/43, 399/71, 343, 346, 350
See application file for complete search history.

(56) References Cited

U.S. PATENT DOCUMENTS

| | | | | |
|---|---|---|---|---|
| 6,771,924 | B2 * | 8/2004 | Matsuguma | 399/350 |
| 7,103,295 | B2 * | 9/2006 | Takura et al. | 399/71 |
| 2003/0063928 | A1 | 4/2003 | Matsuguma | |
| 2007/0201897 | A1 * | 8/2007 | Maeda et al. | 399/350 |
| 2008/0101815 | A1 * | 5/2008 | Yamada | |

FOREIGN PATENT DOCUMENTS

| | | | |
|---|---|---|---|
| JP | 2000019920 A | * | 1/2000 |
| JP | 2003-076103 A | | 3/2003 |
| JP | 2003-215878 A | | 7/2003 |
| JP | 2005-037815 A | | 2/2005 |
| JP | 2005-99215 A | | 4/2005 |
| JP | 2006-091458 A | | 4/2006 |
| JP | 2006-091459 A | | 4/2006 |
| JP | 2006-220982 A | | 8/2006 |
| JP | 2006-251138 A | | 9/2006 |

OTHER PUBLICATIONS

Notice of Allowance (Decision to Grant Patent) from Japanese Patent Office issued in corresponding Japanese Patent Application No. 2009-070122 dated Aug. 23, 2011, with an English translation thereof.

* cited by examiner

*Primary Examiner* — David Gray
*Assistant Examiner* — Laura Roth
(74) *Attorney, Agent, or Firm* — Buchanan Ingersoll & Rooney PC

(57) ABSTRACT

When carrying out monochrome printing, an engine unit of a printer calculates an amount of toner consumed as lubricant by a color photoreceptor according to the number of sheets to be printed (S63). When carrying out color printing, the engine unit calculates an amount of toner remaining on the color photoreceptor after the printing based on an amount of toner necessary for printing calculated from a printing rate and an amount of actually transferred toner that is calculated from the transfer rate (S65). The toner remaining on the color photoreceptor is used as lubricant, and the engine unit calculates an amount of toner by subtracting the residual toner amount from the amount of toner as lubricant calculated from the number of sheets for monochrome printing (S67), and supplies the calculated amount of toner as lubricant to the color photoreceptor when carrying out monochrome printing.

9 Claims, 9 Drawing Sheets

| HUMIDITY (%) | ≤ 50 | 50< |
|---|---|---|
| TRANSFER EFFICIENCY (%) | 95 | 90 |

IMAGE FORMING DEVICE THAT REDUCES CONSUMPTION OF TONER USED FOR NON-PRINTING PURPOSE

This application is based on Japanese Patent Application No. 2009-070122 filed with the Japan Patent Office on Mar. 23, 2009, the entire content of which is hereby incorporated by reference.

BACKGROUND OF THE INVENTION

1. Field of the Invention

The present invention relates to image forming devices, and in particular to a tandem image forming device that forms an image by fusing toner to a print medium.

2. Description of the Related Art

Some image forming devices provided with a developing device for each color and capable of carrying out tandem color printing include a drive mechanism that does not separately control driving of a photoreceptor in the developing device for monochrome printing and driving of a photoreceptor in the developing device for color printing. When carrying out monochrome printing using an image forming device having such a configuration, a photoreceptor for color printing rotates along with a photoreceptor for monochrome printing.

Each photoreceptor is in contact with a cleaner blade for removing residual toner that remains after transfer. When carrying out monochrome printing using the image forming device as described above, a toner for printing is not supplied to the photoreceptor for color printing. Accordingly, when carrying out monochrome printing, the photoreceptor for color printing rotates in a state in which the photoreceptor and the cleaner blade are brought into contact with the toner for printing therebetween. This can lead to deterioration of the photoreceptor for color printing due to friction occurring between the photoreceptor and the cleaner blade.

Therefore, Japanese Laid-Open Patent Publication No, 2005-099215 (hereinafter referred to as Document 1), for example, discloses a technique for supplying the photoreceptor for color printing with a predetermined amount of toner as lubricant between the photoreceptor and the cleaner blade, in addition to toner used for printing purpose when carrying out monochrome printing using an image forming device with such a configuration.

However, as the image forming device disclosed in Document 1 supplies the toner as lubricant in addition to the toner for printing, this poses a problem of increasing consumption of toner used for non-printing purpose.

SUMMARY OF THE INVENTION

The present invention is made in view of the above problems, and an object of the present invention is to provide an image forming device provided with a developing device for each color and capable of carrying out tandem color printing, with which consumption of toner used for non-printing purpose can be reduced.

In order to achieve the above object, according to one aspect of the present invention, an image forming device includes: a first photoreceptor for forming monochrome picture-image that corresponds to black toner; a second photoreceptor for forming color picture-image that corresponds to color toner; cleaner blades that are respectively in contact with the first and second photoreceptors; developing devices corresponding to respective colors of the toner; a drive mechanism for causing the first and second photoreceptors to rotate; a picture-image forming unit for forming an image by transferring a toner image developed on the first and second photoreceptors to an image carrier; a supplying unit for supplying the toner to the first and second photoreceptors; and a controller. The drive mechanism causes the second photoreceptor to rotate when forming a monochrome picture-image using the picture-image forming unit. The controller causes the supplying unit to supply a predetermined amount of toner as lubricant to the second photoreceptor at a timing determined based on an amount of toner remaining on the second photoreceptor after the transfer to the image carrier.

Preferably, the controller includes: a first counter for integrating a first toner amount obtained from the amount of operation of the picture-image forming unit for forming a monochrome image; and a second counter for integrating a second toner amount obtained from the amount of operation of the picture-image forming unit for forming a color image, the second toner amount being the amount of toner remaining on the second photoreceptor, wherein at the timing at which a value obtained by subtracting a value of the second counter from a value of the first counter reaches a threshold value, the controller causes the supplying unit to supply the toner of an amount corresponding to the threshold value as lubricant to the second photoreceptor.

More preferably, the controller calculates the first toner amount by multiplying the amount of operation of the picture-image forming unit for forming a monochrome image by a unit amount of toner, and integrates the first toner amount using the first counter.

Preferably, the controller calculates the second toner amount based on the amount of operation of the picture-image forming unit for forming a color image, a printing rate of the color image, and a transfer rate from the second photoreceptor to the image carrier, and integrates the second toner amount using the second counter, the second toner amount being the amount of toner remaining on the second photoreceptor after the transfer to the image carrier.

More preferably, the controller calculates the second toner amount using the transfer rate corresponding to an environmental condition within the image forming device, the second toner amount being the amount of toner remaining on the second photoreceptor after the transfer to the image carrier.

Preferably, in the image forming device, the second photoreceptor includes a plurality of color photoreceptors respectively corresponding to the plurality of colors of the toner. The second counter integrates each of the colors of the toner, the controller calculates the second toner amount for each color of the toner and integrates the second toner amount using the second counter for the corresponding color, the second toner amount being the amount of toner remaining on the second photoreceptor after the transfer to the image carrier, and the controller causes the supplying unit to supply the toner of the predetermined amount to one of the color photoreceptors at the timing at which the threshold value is reached, the one of the color photoreceptors having the value obtained by subtracting corresponding one of the values of the second counter from the value of the first counter reaches the threshold value.

Alternatively, it is preferable that, in the image forming device, the second photoreceptor includes a plurality of color photoreceptors respectively corresponding to the plurality of colors of the toner. The second counter integrates each of the colors of the toner, the controller calculates the second toner amount for each color of the toner and integrates the second toner amount using the second counter for the corresponding color, the second toner amount being the amount of toner remaining on the second photoreceptor after the transfer to the image carrier, and the controller causes the supplying unit to supply the toner of the predetermined amount to all of the color photoreceptors at the timing at which the value obtained by subtracting at least one of the values integrated by the second counter for the respective colors of the toner from the value of the first counter reaches the threshold value.

Preferably, the controller sets the value obtained by subtracting the value of the second counter from the value of the first counter to 0 when the value of the second counter is greater than the value of the first counter.

Preferably, the controller causes the supplying unit to supply the predetermined amount of toner in a period between one image forming operation and a subsequent image forming operation by the picture-image forming unit during which an image forming operation is not carried out, wherein the controller sets the period by extending an interval between the image forming operations.

Alternatively, it is preferable that the controller causes the supplying unit to supply the predetermined amount of toner in a period during which an image forming operation by the picture-image forming unit is not carried out, wherein the controller sets the period by temporarily stopping the image forming operation.

According to the present invention; it is possible to reduce consumption of toner used for non-printing purpose with an image forming device provided with a developing device for each color and capable of carrying out tandem color printing.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
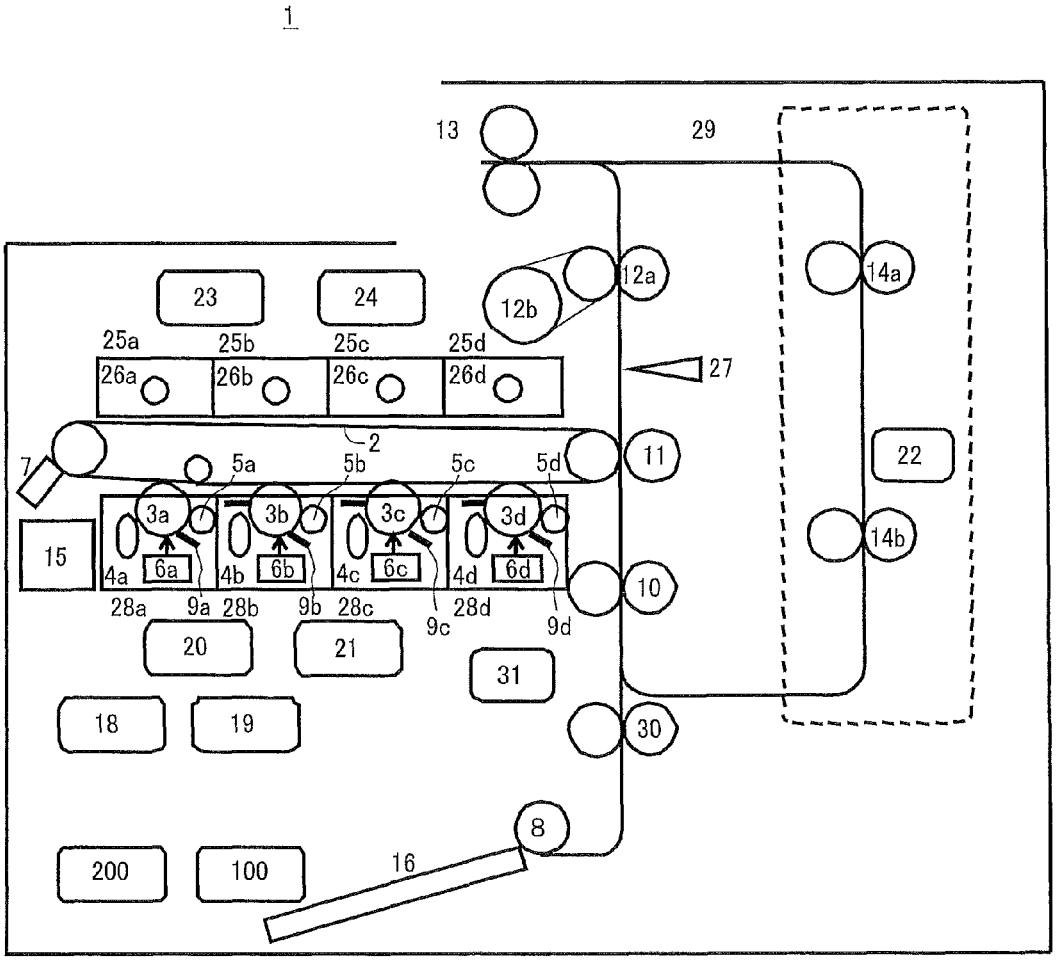
FIG. 1 is a schematic diagram illustrating a specific example of a cross-section at a central portion of a printer according to an embodiment.

An embodiment of the present invention will be described below with reference to the drawings. In the following description, like components and components are denoted by like reference numerals. Names and functions of thereof are also the same.

While an example in which an image forming device is a tandem color printer (hereinafter referred to as a printer) is described in the following description, the image forming device is not limited to a printer. The image forming device may be a copying machine, a facsimile, or an MFP (Multi Function Peripheral) that is a device having these functions integrated therein.

Referring to FIG. 1, a printer 1 according to the present embodiment is provided with an image formation unit and a carrying unit of paper as a print medium.

The image formation unit includes a belt 2 as an intermediate transfer member provided substantially at a center within printer 1 and suspended internally with a plurality of rollers. Along belt 2, a cartridge 28*a* that corresponds to Yellow (Y), a cartridge 28*b* that corresponds to Magenta (M), a cartridge 28*c* that corresponds to Cyan (C), and a cartridge 28*d* that corresponds to Black (K) are disposed. These components are representatively referred to as cartridges 28.

Cartridges 28 include, as a toner picture-image forming mechanism that forms a toner image using an electrostatic recording method, photoreceptors 3*a*, 3*b*, 3*c*, and 3*d*, charging units 5*a*, 5*b*, 5*c*, and 5*d*, exposing units 6*a*, 6*b*, 6*c*, and 6*d*, developing units 4*a*, 4*b*, 4*c*, and 4*d*, and cleaner blades 9*a*, 9*b*, and 9*c*, and 9*d*, respectively. These components are representatively referred to as photoreceptors 3, charging units 5, exposing units 6, developing units 4, and cleaner blades 9, respectively.

Each of developing units 4 includes a developing roller and a supplying roller that are not shown in the drawing. Further, each developing unit 4 includes a space for filling toner that is not shown in the drawing. When developing unit 4 is operated, the supplying roller is rotated and the toner within this space is supplied to the developing roller. The developing roller is disposed at a position that corresponds to corresponding one of photoreceptors 3, and carries the supplied toner to a position that faces toward photoreceptor 3. As a surface of photoreceptor 3 is exposed, the toner on the developing roller moves to an exposed portion of photoreceptor 3 at the position that faces toward photoreceptor 3. As a result, a toner image is formed on photoreceptor 3.

Charging units 5 evenly charge the surfaces of photoreceptors 3. Each of exposing units 6 exposes an image pattern of the corresponding color on photoreceptor 3, thereby forming a latent image. Each developing unit 4 supplies the toner to photoreceptor 3 and develops a toner image on photoreceptor 3. Each photoreceptor 3 transfers the toner image formed on belt 2.

Cleaner blades 9 are brought in contact with photoreceptors 3 and take residual toner off from photoreceptors 3. This mechanism will be described later.

The image formation unit further includes an intermediate transfer belt cleaner 7, a waste toner box 15, toner bottles 25*a*, 25*b*, 25*c*, and 25*d*, and a secondary transfer roller 11.

Intermediate transfer belt cleaner 7 is disposed around belt 2, and separates residual toner on belt 2 from belt 2.

Waste toner box 15 is used to contain the separated residual toner. Toner bottles 25*a*, 25*b*, 25*c*, and 25*d* respectively include agitating blades 26*a*, 26*b*, 26*c*, and 26*d*, and operate the respective agitating blades to supply toner to corresponding cartridges 28.

Secondary transfer roller 11 forms a pair with a roller that internally suspends belt 2 with belt 2 interposed therebetween, and transfers the toner image that has been transferred to belt 2 on a paper sheet that has been carried.

A sensor 31 is disposed around the image formation unit, and measures an environment around the image formation unit. The measured environment is an environment relating to an image forming function, and at least one condition of the environment such as humidity, temperature, and an atmospheric pressure is measured. Sensor 31 may be provided around each cartridge of the corresponding toner color.

The carrying unit includes a paper feeding roller 8, a carrying roller 30, timing roller 10, secondary transfer roller 11 as described above, a pair of fuser rollers 12*a* and 12*b* (representatively referred to as fuser rollers 12), a paper discharge roller 13, double-side path carrying rollers 14*a* and 14*b*, and a paper sheet detecting sensor 27.

Paper feeding roller 8 feeds a paper sheet from a container 16 as a cassette for containing paper sheets that is disposed at a lower portion within printer 1. Carrying roller 30 carries the paper sheet that has been fed by paper feeding roller 8. Timing roller 10 temporarily stops the paper sheet that is carried by carrying roller 30. Fuser rollers 12 are disposed with the paper sheet that is carried interposed therebetween, and fuses the toner image transferred onto the paper sheet by heating. Paper discharge roller 13 discharges the paper sheet that has been fused or carries the paper sheet to a double-side carrying path 29. Double-side path carrying rollers 14*a* and 14*b* carries the fused paper sheet carried by paper discharge roller 13 to timing roller 10 through double-side carrying path 29. Paper sheet detecting sensor 27 is disposed at a position in the carrying path at which the paper sheet comes immediately after passing through secondary transfer roller 11, and senses that a frontal end of the paper sheet and/or a rear end of the paper sheet pass through this position.

Figure 2A:
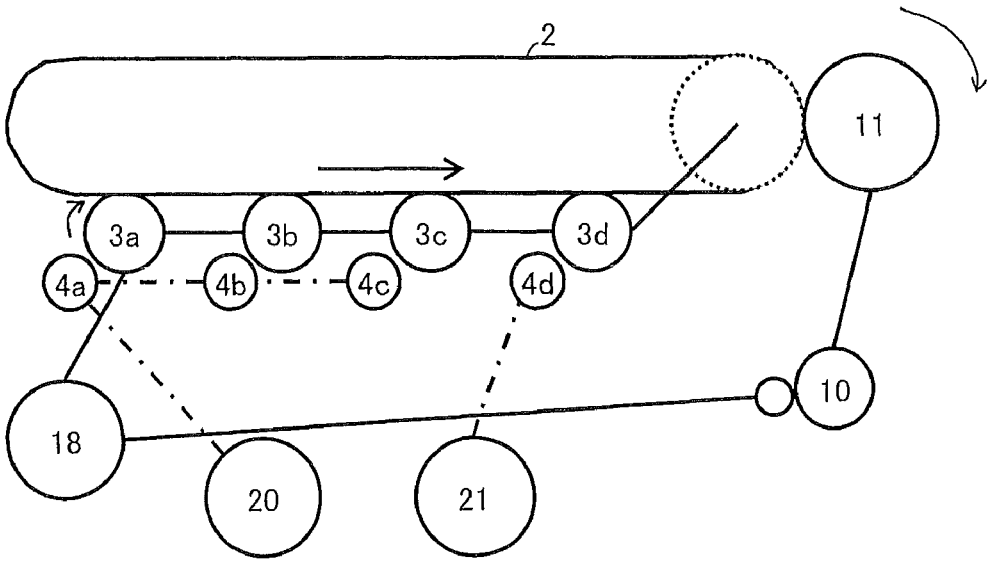
FIGS. 2A and 2B are partial schematic diagrams of a driving configuration of the printer.

As shown in FIG. 2A, photoreceptors 3*a*, 3*b*, 3*c*, and 3*d*, secondary transfer roller 11, and timing roller 10 are connected to a main motor 18. Main motor 18 drives these rollers to rotate in a clockwise direction as shown by an arrow in the figure.

Out of developing units 4 included in cartridge 28, developing units 4*a*, 4*b*, and 4*c* for color printing are connected to a developing motor 20, and developing unit 4*d* for monochrome printing is connected to a developing motor 21. Developing motor 20 drives developing units 4*a*, 4*b*, and 4*c* for color printing, and developing motor 21 drives developing unit 4*d* for monochrome printing.

Figure 2B:
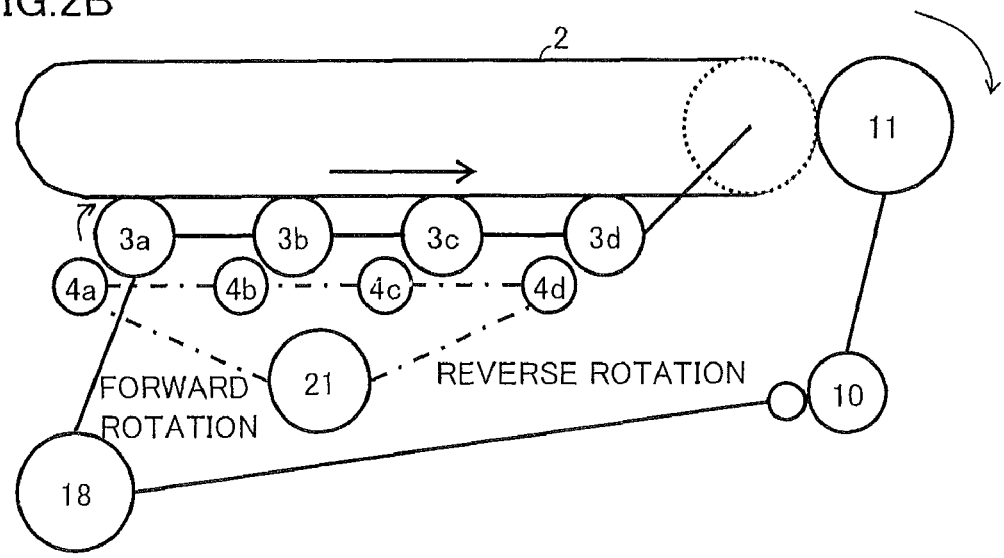

Alternatively, as shown in FIG. 2B, developing motor 20 is not included in printer 1, and all of developing units 4 included in cartridge 28 may be connected to developing motor 21. In this case, developing motor 21 drives only developing unit 4*d* for monochrome printing by rotating in a forward direction and drives all of developing units 4*a*, 4*b*, 4*c*, and 4*d* by rotating in a reverse direction.

Because of the configuration as shown in FIG. 2A or 2B, all of photoreceptors 3*a*, 3*b*, 3*c*, and 3*d* that are connected in series to main motor 18 are driven to rotate by main motor 18. Accordingly, even when carrying out monochrome printing, photoreceptors 3*a*, 3*b*, and 3*c* for color printing are also driven to rotate along with photoreceptor 3*d* for monochrome printing. Developing unit 4*d* can be driven to rotate separately from developing units 4*a*, 4*b*, and 4*c*, either by being connected to developing motor 21 that is different from a motor to which developing units 4*a*, 4*b*, and 4*c* for color printing are connected (FIG. 2A), or by developing motor 21 rotating in the reverse direction (FIG. 2B).

Toner bottles 25*a* and 25*b* are connected to a toner supplying motor 23, and toner bottles 25*c* and 25*d* are connected to a toner supplying motor 24. Agitating blades 26*a*, 26*b*, 26*c*, and 26*d* are operated by rotary drive of the motor. Fuser rollers 12 are connected to a fuse motor 19, and rotated by rotary drive of fuse motor 19. Double-side path carrying rollers 14*a* and 14*b* are connected to double-side path carrying motor 22, and rotated by rotary drive of double-side path carrying motor 22.

Figure 3:
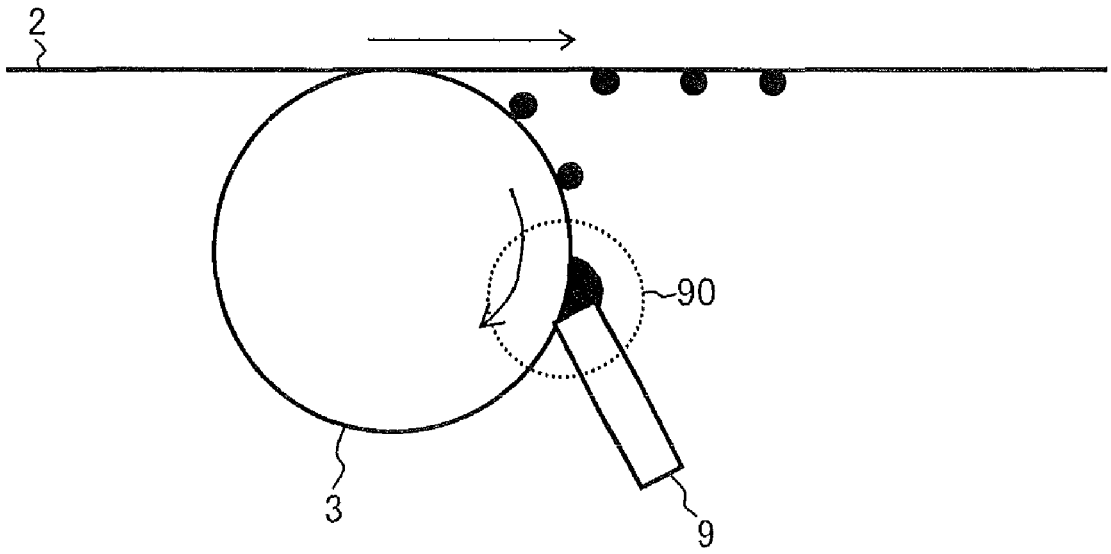
FIG. 3 is a schematic diagram of a configuration of a photoreceptor and a cleaner blade.

As shown in FIG. 3, photoreceptor 3 rotates by main motor 18 driving in a state in which photoreceptor 3 is in contact with cleaner blade 9. With this configuration, the residual toner on the surface of photoreceptor 3 is taken off by cleaner blade 9. The residual toner that has been taken off is discharged to a path for collecting waste toner that is not shown in the drawing, and forms a toner pool at a portion 90 at which cleaner blade 9 and photoreceptor 3 are in contact with each other, which is partially shown by a dotted line in the figure, or more specifically, at an edge portion of cleaner blade 9 that is in contact with photoreceptor 3. As the toner that forms the toner pool is present between cleaner blade 9 and photoreceptor 3, the toner serves as lubricant, and it is possible to suppress friction between cleaner blade 9 and photoreceptor 3 due to the rotation of photoreceptor 3.

Figure 4:
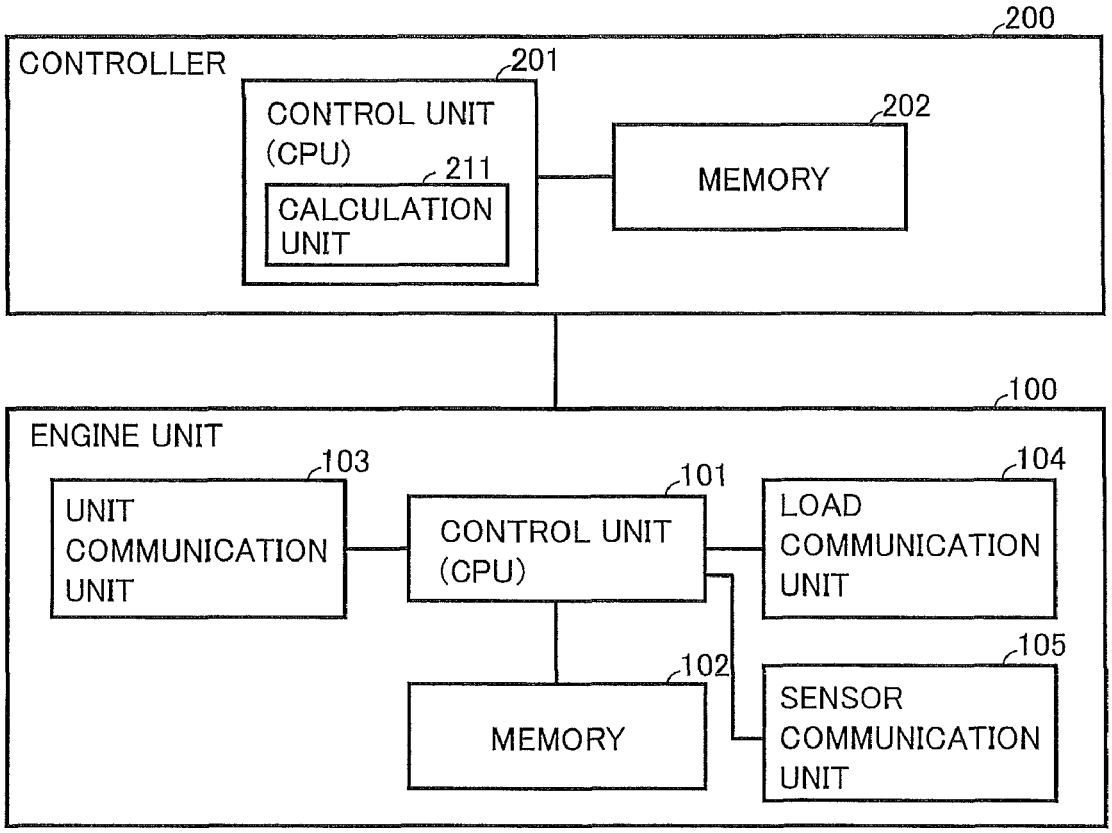
FIG. 4 is an illustrative view of an engine unit and a controller of the printer.

Printer 1 further includes an engine unit 100 that controls an overall operation and a controller 200 that carries out image processing according to a control signal from engine unit 100. Referring to FIG. 4, engine unit 100 includes a control unit 101 including a CPU (Central Processing Unit), a nonvolatile memory 102 that is attached to engine unit 100, a unit communication unit 103 for communicating with a nonvolatile memory that is attached to cartridge 28 and the like, a load communication unit 104 for communicating with various loads such as main motor 18, and a sensor communication unit 105 for communicating with sensor 31. Controller 200 includes a control unit 201 including a CPU and a nonvolatile memory 202 that is attached to controller 200.

Memory 102 stores a program that is executed by control unit 101, and memory 202 stores a program that is executed by control unit 201. Control units 101 and 201 control printer 1 as a whole by reading necessary programs from memories 102 and 202 and causing the CPUs to execute the programs.

The memory that is attached to cartridge 28 and the like stores information of consumables, and unit communication unit 103 reads the information of consumables from the memory according to a control signal of control unit 101 and passes the information to control unit 101. Further, load communication unit 104 transmits a control signal generated by control unit 101 to a load that is to be controlled by the generated signal.

Referring further to FIG. 4, control unit 201 of controller 200 includes a calculation unit 211. While calculation unit 211 is a function that is realized mainly by the CPU of control unit 201 executing the program, calculation unit 211 can be implemented as a different configuration other than the CPU.

Calculation unit 211 calculates a printing rate from image data to be printed. The printing rate refers to a ratio of an image area to a printing area in a paper sheet. Specifically, the number of dots that configure an image to be printed is divided by the number of dots that corresponds to a printing area of a printing paper sheet.

Calculation unit 211 extracts the image area (the number of dots that form the image) from the image data to be printed.

Figures 5A, 5B:
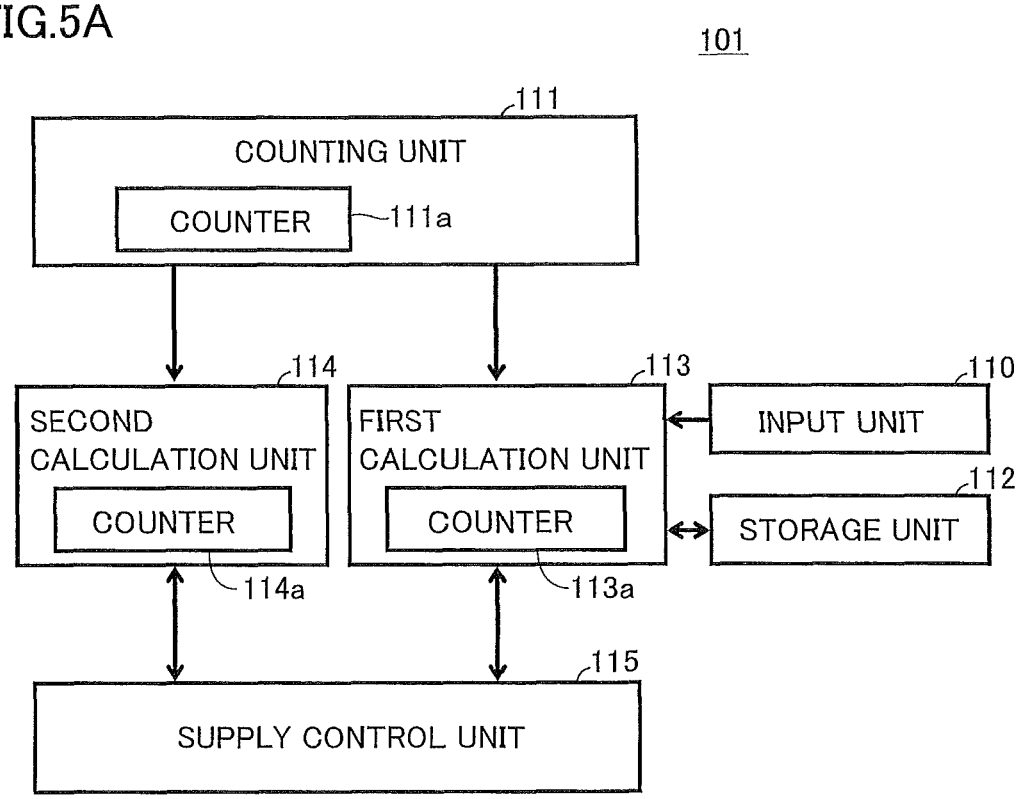
FIG. 5A is a diagram illustrating a specific example of a functional configuration of the engine unit.
FIG. 5B is a diagram illustrating a specific example of a transfer rate according to an environmental condition that is stored.

Further, calculation unit 211 stores in advance the printing area (the number of dots for the printing area) for each size of paper. Calculation unit 211 calculates the printing rate by dividing the number of dots that form the extracted image by the number of dots corresponding to the printing area that is stored for a specified size of the paper sheet. Preferably, calculation unit 211 extracts the image area for each toner color from the image data to be printed, and calculates the printing rate for each toner color. Calculation unit 211 outputs the calculated printing rate to engine unit 100 along with a print instruction, Control unit 101 of engine unit 100 includes, as shown in FIG. 5A, an input unit 110 for inputting an environmental condition, a counting unit 111 for counting an amount of rotation, a storage unit 112, a first calculation unit 113 for calculating an amount of residual toner, a second calculation unit 114 for calculating an amount of toner as lubricant, and a supply control unit 115. While these are functions that are realized mainly by the CPU of control unit 101 executing the program described above, these functions can be implemented as a different configuration other than the CPU.

Input unit 110 accepts an input, from sensor communication unit 105 that communicates with sensor 31, of an environment value such as humidity and temperature received from the sensor. The accepted environment value is inputted to first calculation unit 113, Counting unit 111 includes a counter 111*a*. Counting unit 111 counts an amount of rotation of the developing roller such as timing roller 10 and secondary transfer roller 11, and integrates the amount of rotation using counter 111*a*. The amount of rotation of the developing roller is also considered as a driving amount for image formation of developing unit 4. Preferably, counting unit 111 includes counter 111*a* for each color, and counts the amount of rotation of the developing roller for each color. Counting unit 111 at least includes counter 111*a* for monochrome printing and counter 111*a* for color printing, and counts the amount of rotation of the developing roller for each print mode.

As shown in FIG. 5B, storage unit 112 stores transfer efficiency that corresponds to the environmental condition. Specifically, while photoreceptor 3 and belt 2 are fixed, a positional relation of these components can change depending on the environment due to characteristics of materials. With the change of the position, there is a case where the toner image on photoreceptor 3 cannot be completely transferred to belt 2 and remains on photoreceptor 3. The toner remaining on photoreceptor 3 after the transfer is referred to as "remaining toner" or "residual toner". As the positional relation between photoreceptor 3 and belt 2 changes according to the environment, the transfer efficiency changes according to the environment. In other words, an amount of residual toner also changes according to the environment, While FIG. 5B shows the transfer efficiency that is associated with the humidity as a condition of the environment that most affects the transfer efficiency, temperature or an atmospheric pressure that can be measured by sensor 31 may also be taken as an environmental condition that affects the transfer efficiency, or two or more of humidity, temperature, and the atmospheric pressure may be combined as the environmental condition.

First calculation unit 113 calculates the amount of residual toner on photoreceptors 3*a*, 3*b*, and 3*c* for color printing for each page of color printing. The amount of residual toner for each page can be obtained by subtracting an amount of toner that is actually transferred from photoreceptor 3 to belt 2 from an amount of toner consumed to print the page. The amount of toner consumed to print a single page can be obtained by multiplying an amount of toner consumed when forming an image without spaces on a printing paper sheet by a printing rate of this page. First calculation unit 113 stores the amount of toner consumed when forming an image without spaces on a paper sheet as a reference consumption, and multiplies this amount by the printing rate entered by controller 200, thereby calculating the amount of toner consumed to print the page.

The amount of toner that is actually used in the transfer out of the amount of toner consumed to print the page can be obtained by multiplying the amount of toner consumed to print the page by the transfer efficiency. As the transfer efficiency is affected by the environment as described above, first calculation unit 113 calculates the amount of toner used for the transfer by reading the transfer efficiency when carrying out color printing out of the transfer efficiency of the environmental conditions stored in storage unit 112 taking an environment value when carrying out color printing that is entered by input unit 110 as the environmental condition. First calculation unit 113 includes a counter 113*a*, and integrates the calculated amount of residual toner using counter 113*a*.

Preferably, first calculation unit 113 includes counter 113 a for each toner color. In this case, first calculation unit 113 calculates the amount of residual toner for each toner color by calculating the amount of toner consumed to print the page using the printing rate calculated by calculation unit 211 for each toner color, and integrates the amount of residual toner for each toner color using corresponding counter 113*a*.

Second calculation unit 114 stores in advance a unit amount of toner necessary as lubricant for photoreceptors 3*a*, 3*b*, and 3*c* for color printing for a single sheet of monochrome printing which will be described later. Second calculation unit 114 calculates, based on the amount of rotation of the developing roller in monochrome printing and the unit amount, the amount of toner necessary as lubricant, that is, the amount of toner consumed as lubricant by photoreceptors 3*a*, 3*b*, and 3*c* for color printing that is in operation when carrying out monochrome printing. Second calculation unit 114 includes a counter 114*a*, and integrates the calculated amount of toner necessary as lubricant using counter 114*a*. Similarly to first calculation unit 113, second calculation unit 114 can include counter 114*a* for each toner color.

As described above, when carrying out printing, belt 2 and photoreceptor 3 are brought into contact with each other. As described above, photoreceptors 3*a*, 3*b*, 3*c*, and 3*d* are driven to rotate by main motor 18, both when carrying out color printing and when carrying out monochrome printing. When carrying out color printing, developing units 4*a*, 4*b*, and 4*c* for color printing are driven by developing motor 20, and developing unit 4*d* for monochrome printing is driven by developing motor 21, thereby forming toner images on photoreceptors 3*a*, 3*b*, 3*c*, and 3*d*. When carrying out monochrome printing, developing unit 4*d* for monochrome printing is driven by developing motor 21, thereby forming a toner image only on photoreceptor 3*d* for monochrome printing. Driving developing units 4*a*, 4*b*, and 4*c* for color printing that are not used when carrying out monochrome printing causes the toner within cartridges 28*a*, 28*b*, and 28*c* for color printing to be scraped and frictioned with developing blades or the like that are not shown in the drawing, and deteriorated. Therefore, developing units 4*a*, 4*b*, and 4*c* for color printing are not driven. On the other hand, the toner within cartridges 28*a*, 28*b*, and 28*c* for color printing is not supplied to photoreceptors 3*a*, 3*b*, and 3*c* for color printing that are not used when carrying out monochrome printing. Therefore, the toner pools are not formed at contact portions 90 respectively between photoreceptors 3*a*, 3*b*, and 3*c* and cleaner blades 9*a*, 9*b*, and 9*c*. As a result, photoreceptors 3*a*, 3*b*, and 3*c* rotate directly in contact with cleaner blades 9*a*, 9*b*, and 9*c* without the toner interposed therebetween.

Supply control unit 115 carries out a supply operation, at a predetermined timing, of supplying toner that is not used for printing to photoreceptors 3*a*, 3*b*, and 3*c*, in order to suppress frictional loads between photoreceptors 3*a*, 3*b*, and 3*c* and cleaner blades 9*a*, 9*b*, and 9*c* when carrying out monochrome printing and to prevent the cleaner blades from being scraped or a rotary torque from increasing. The supplied toner forms the toner pool at contact portion 90, and serves as lubricant.

Supply control unit 115 calculates an amount obtained by subtracting the amount of residual toner on photoreceptors 3*a*, 3*b*, and 3*c* for color printing calculated by first calculation unit 113 from the amount of toner necessary as lubricant calculated by second calculation unit 114 as an integrated toner amount as an amount of toner to be supplied as lubricant. Supply control unit 115 calculates the integrated toner amount by subtracting a counting value of counter 113*a* from a counting value of counter 114*a*.

Supply control unit 115 stores in advance the amount of toner to be supplied as lubricant in a single supply operation as a threshold value. Supply control unit 115 compares the amount of toner stored as the threshold value and the calculated integrated toner amount. When the integrated toner amount reaches the amount of toner to be supplied, supply control unit 115 determines that it is the timing at which the toner as lubricant is to be supplied. When supplying the toner as lubricant, supply control unit 115 outputs a control signal to a necessary operational mechanism that is not shown in the drawing, and causes the mechanism to interrupt the printing operation and to supply the toner of the above described amount that is stored as the threshold value during a non-image-forming period. As used herein, the "non-image-forming period" may be a period during which the printing operation is temporarily stopped, or may be a period between image forming operations that is provided by extending an interval between the image forming operations longer than usual.

It was confirmed by the experimentation by the inventor that it is adequate to supply the toner as lubricant of about 40 mg to each of photoreceptors 3*a*, 3*b*, and 3*c* for color printing for every 100 sheets in monochrome printing. Therefore, the unit amount for the amount of toner necessary as lubricant per sheet for monochrome printing stored in second calculation unit 114 can be, for example, 0.4 mg. It should be noted that it is possible to increase the amount of toner held as the toner pool depending on a shape of contact portion 90 between cleaner blade 9 and photoreceptor 3.

Examples of supplying the toner as lubricant includes, as described above, supplying toner of 40 mg every time when 100 sheets of monochrome printing is carried out. It is possible to supply the toner more stably by supplying toner of 40 mg every time when printing 100 sheets of paper than by supplying toner of 0.4 mg every time when printing a single sheet of paper. Further, it is possible to reduce the number of times of driving cartridges 28*a*, 28*b*, and 28*c* to supply the toner. Accordingly, supply control unit 115 stores the amount of toner necessary as lubricant for a predetermined number of printing sheets (here, 40 mg for every 100 sheets) as the threshold value.

Preferably, supply control unit 115 controls the supply by calculating the integrated toner amount for each toner color by subtracting the counting value of counter 113*a* for each toner color from the counting value of counter 114*a*, and determining whether or not it is the timing to supply the toner as lubricant for each toner color. Supply control unit 115 resets counter 114*a* and counter 113*a* when the supply operation has been carried out.

Figure 6:
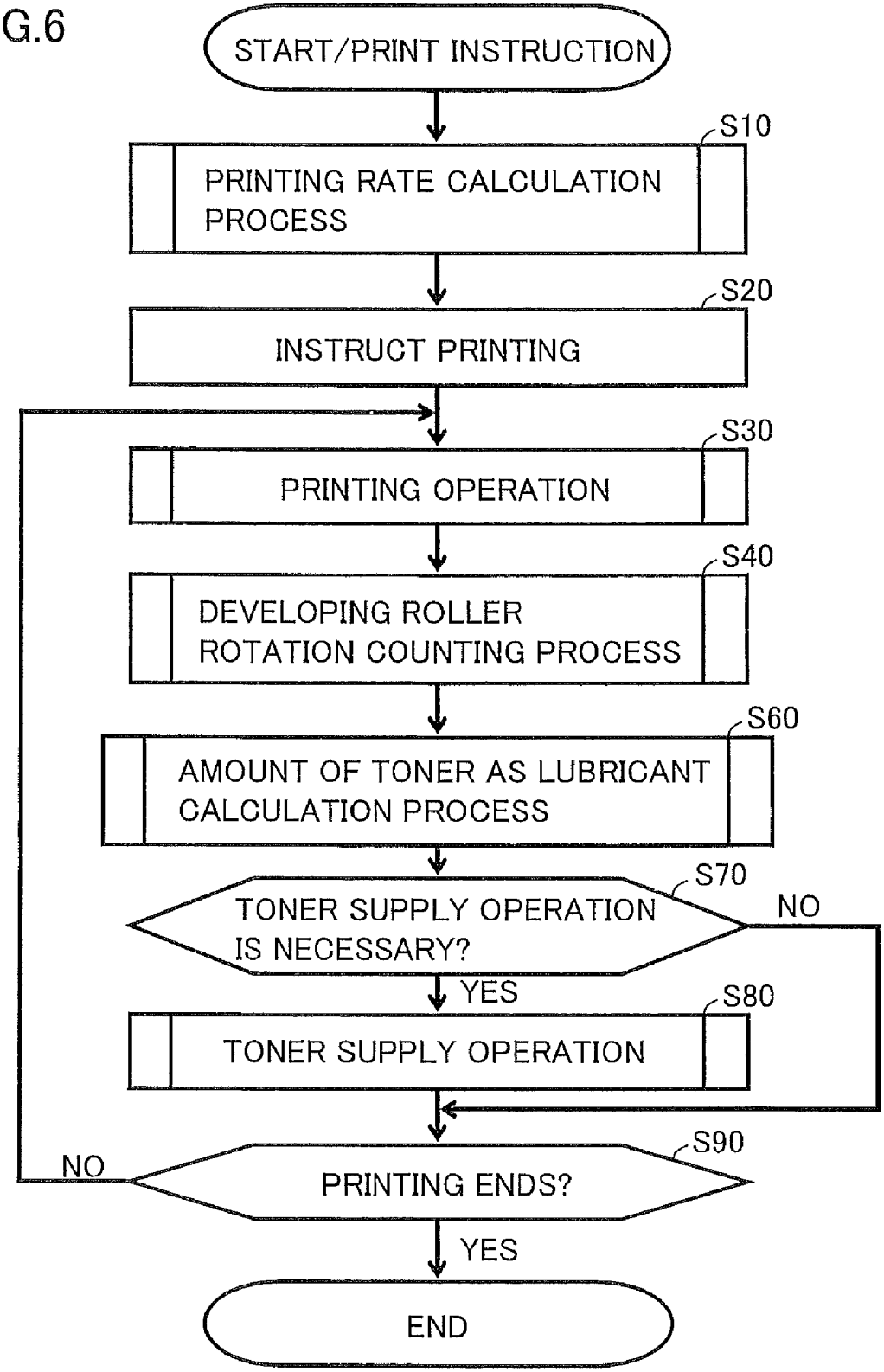
FIG. 6 is a flow chart of a specific example of a flow of an operation of the printer according to the embodiment.

An operational flow of printer 1 is described referring to FIG. 6. An operation shown in a flow chart of FIG. 6 is an operation started by the print instruction issued by an operation unit of printer 1 that is not shown in the drawing, or other devices connected to printer 1 that are not shown in the drawing, and implemented by control unit 101 of engine unit 100 and control unit 201 of controller 200 reading necessary programs respectively from memories 102 and 202 and causing the respective CPUs to execute the programs to control the components shown in FIGS. 4 and 5A.

Referring to FIG. 6, after calculation unit 211 calculates the printing rate from the image data to be printed in step S10, controller 200 outputs the printing rate along with the print instruction to engine unit 100 in step S20.

The printing operation is carried out in step S30 by being controlled by control unit 101 of engine unit 100. When the printing operation starts, counting unit 111 counts the amount of rotation of the developing roller at a predetermined interval, for example, every time when a single sheet is printed in step S40.

Figure 7:
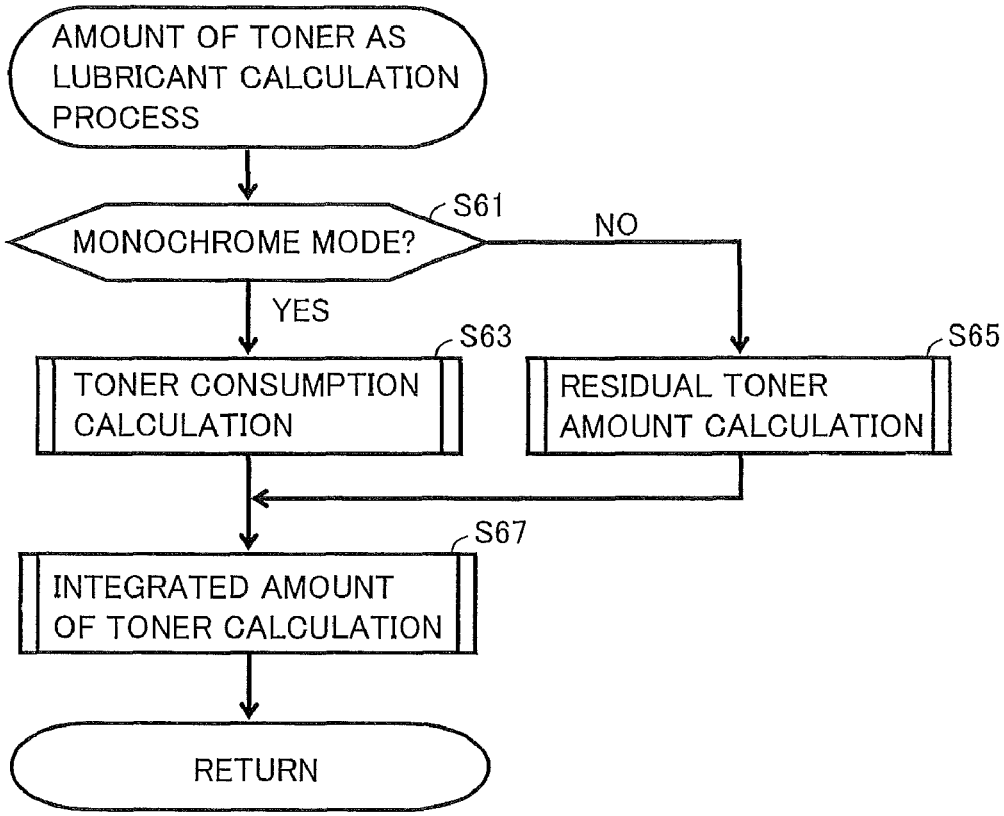
FIG. 7 is a flow chart of a specific example of a flow of an operation of calculating an amount of toner necessary as lubricant during the operation shown in FIG. 6.
Figure 8:
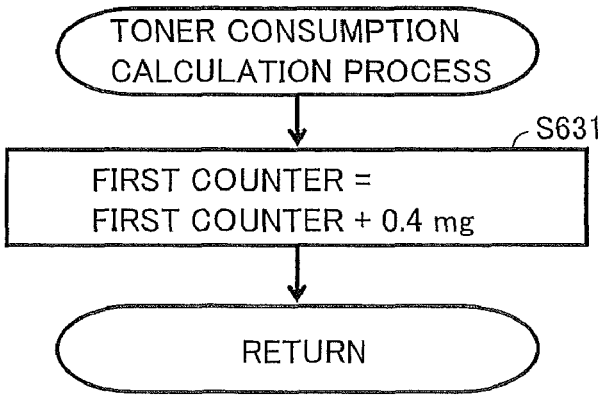
FIG. 8 is a flow chart of a specific example of a flow of an operation of calculating an amount of toner consumed as lubricant in a monochrome mode during the operation shown in FIG. 7.

Next, in step S60, first calculation unit 113 and second calculation unit 114 carry out an operation shown in FIG. 7, and calculate the amount of toner necessary as lubricant. Specifically, referring to FIG. 7, if a printing mode is the monochrome mode (YES in step S61), in step S63, second calculation unit 114 adds the unit amount of the amount of toner necessary as lubricant for photoreceptors 3*a*, 3*b*, and 3*c* for color printing to counter 114*a*, as shown in FIG. 8, for every single page of monochrome printing (step S631). In an example of FIG. 8, the addition is made by 0.4 mg each time.

Figure 9:
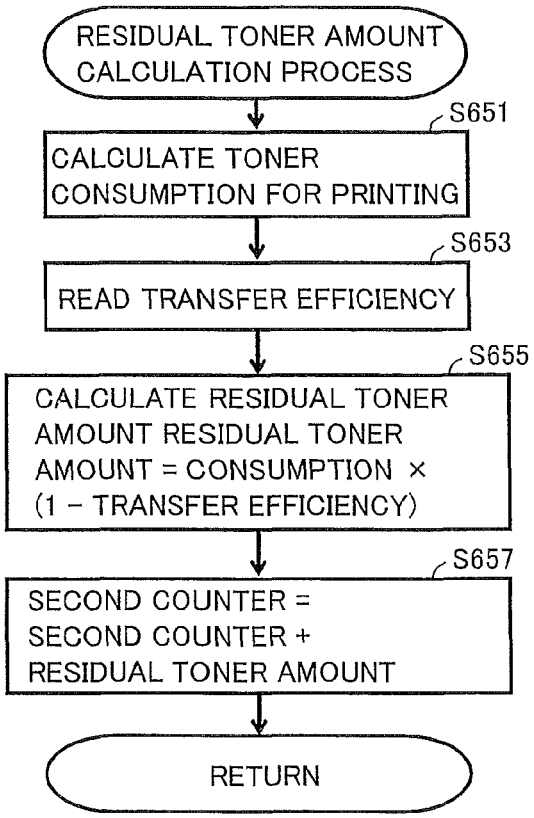
FIG. 9 is a flow chart of a specific example of a flow of an operation of calculating an amount of toner that remains on a color photoreceptor after transfer, carried out in a color mode during the operation shown in FIG. 7.

If the printing mode is the color mode (NO in step S61), in step S65, first calculation unit 113 carries out an operation shown in FIG. 9 and calculates the amount of residual toner. Specifically, referring to FIG. 9, in step S651, the amount of toner to be consumed for a single page of color printing is calculated by multiplying the amount of toner to be consumed when forming the image without spaces in a printing paper sheet by the printing rate of this page. First calculation unit 113 reads the transfer efficiency that corresponds to the environmental condition that has been entered by storage unit 112 in step S653, and, in step S655, calculates the amount of residual toner by subtracting the amount of toner that is actually used for the transfer from the amount of toner to be consumed for a single page of color printing that has been calculated in step S651. In step S655, the amount of residual toner is calculated based on, for example, the following equation.

$$\text{Residual Toner Amount} = \text{Amount of Toner to be Consumed for Single Page of Color Printing} \times (1 - \text{Transfer Efficiency}).$$

In step S653, first calculation unit 113 adds the amount of residual toner calculated in step S655 to counter 113*a*.

It should be noted that, in step S65, the amount of residual toner may be calculated for each toner color. In this case, the amount of residual toner calculated for the corresponding toner color is added to counter 113*a* corresponding to the toner color.

Figure 10:
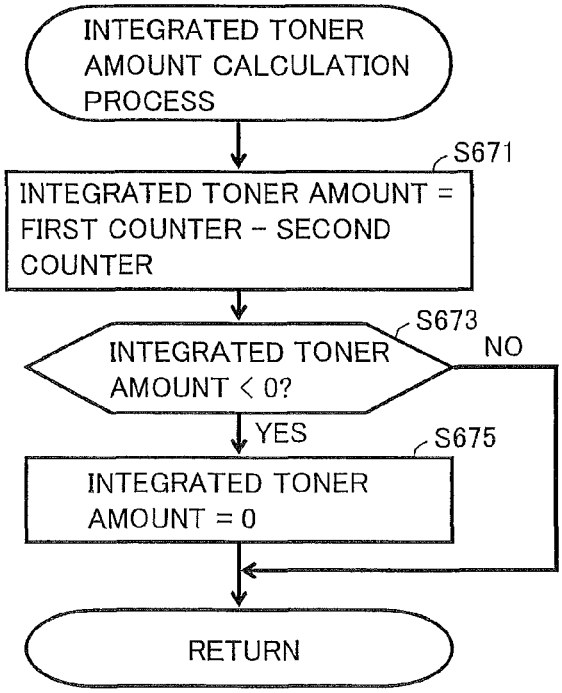
FIG. 10 is a flow chart of a specific example of a flow of an operation of calculating an integrated amount of toner during the operation shown in FIG. 7.

When either the calculation of the amount of toner necessary as lubricant in step S63, or the calculation of the amount of residual toner in step S65 is carried out, supply control unit 115 calculates the integrated toner amount as the amount of toner to be supplied as lubricant in step S67, as shown in FIG. 10, based on the counting value of counter 114*a* as the integrated toner amount of the toner necessary as lubricant and the counting value of counter 113 a as the integrated amount of the amount of residual toner. Specifically, referring to FIG. 10, in step S671, supply control unit 115 calculates the integrated toner amount by subtracting the counting value of counter 113 a from the counting value of counter 114*a*. As the integrated toner amount of the toner to be supplied as lubricant does not become a negative value, if the calculation result in step S671 is negative (YES in step S673), the integrated toner amount is set to be 0 (step S675). Preferably, the calculation of the integrated toner amount shown in FIG. 10 is carried out for each toner color.

Figure 11:
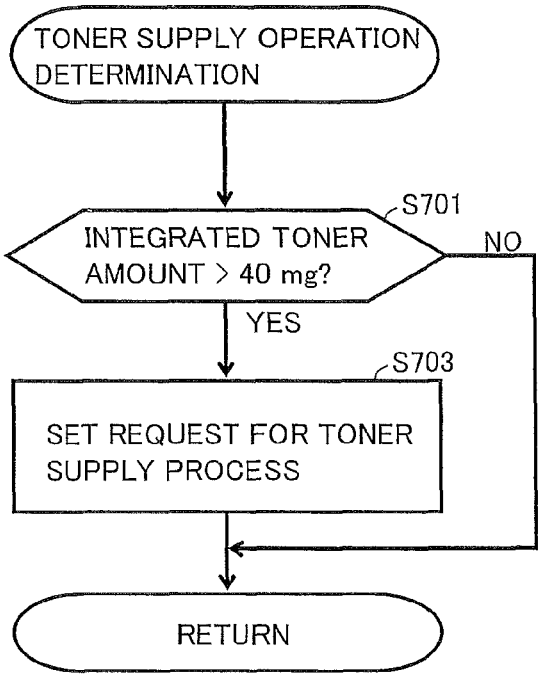
FIG. 11 is a flow chart of a specific example of a flow of an operation of determining whether or not a supply operation is necessary.

After the amount of toner to be supplied as lubricant is calculated through the above process (step S60), as shown in FIG. 11, a process of comparing the integrated toner amount that has been calculated in step S60 with the threshold value is carried out, and it is determined whether or not the operation of supplying the toner as lubricant is necessary. Specifically, referring to FIG. 11, the integrated toner amount that has been calculated in step S60 is compared with 40 mg which is the amount of toner to be supplied as lubricant in the single supply operation stored as the threshold value, and if it is determined that the calculated integrated toner amount reaches the threshold value of 40 mg (YES in step S701), it is determined to be the timing to supply the toner as lubricant to each of photoreceptors 3*a*, 3*b*, and 3*c* for color printing, and a request for the operation is set in step S703. When the integrated toner amount is calculated for each toner color, the operation in step S11 is carried out for each toner color and the timing for supplying the toner as lubricant is determined for each toner color. Further, preferably, the request for the operation for each color may be set by determining the toner as lubricant is to be supplied to all of photoreceptors 3*a*, 3*b*, and 3*c* for color printing when the integrated toner amount is calculated for each toner color and when it is determined to be the timing for supplying the toner as lubricant for one of the toner colors in the operation in step S11.

Figure 12:
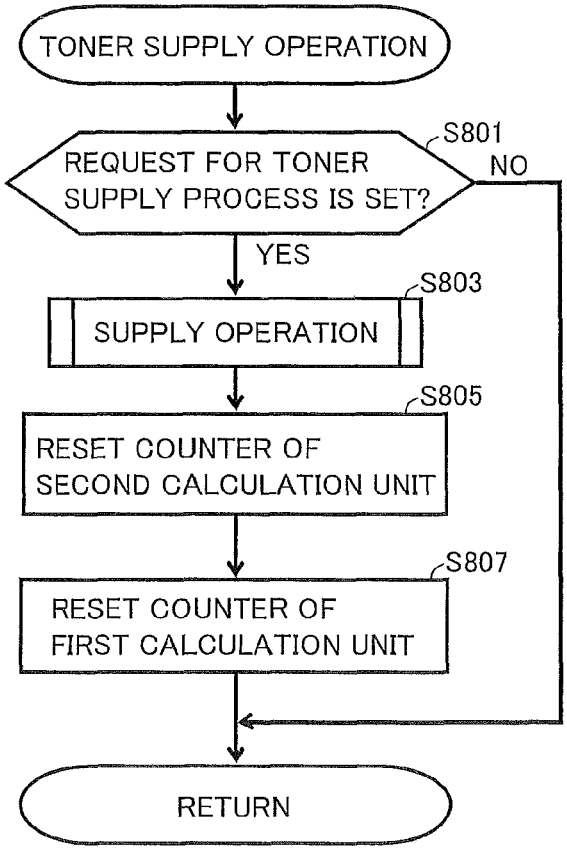
FIG. 12 is a flow chart of a specific example of a flow of the toner supply operation during the operation shown in FIG. 6.

As a result of the above determination, when the request for the toner supply operation is set (YES in step S70), supply control unit 115 carries out an operation as shown in FIG. 12 in step S80, and causes the necessary supply operation to be carried out. Specifically, referring to FIG. 12, when the request for the toner supply operation is set based on the above determination (YES in step S801), supply control unit 115 interrupts the printing operation that is being carried out in step S803, and outputs a control signal for carrying out the operation of supplying the toner of the amount that is stored as the threshold value (40 mg in the above example) as lubricant to each of photoreceptors 3*a*, 3*b*, and 3*c* for color printing to the necessary load during the non-image-forming period. As a result, the toner of the above amount is supplied as lubricant to each of photoreceptors 3*a*, 3*b*, and 3*c* for color printing. Then, in steps S805 and S807, supply control unit 115 resets counter 114*a* and counter 113*a*. Preferably, supply control unit 115 supplies the toner as lubricant to photoreceptor 3 that corresponds to the toner color for which the request for the toner supply operation is set.

As the above operations are carried out in printer 1, the toner supplied to photoreceptors 3*a*, 3*b*, and 3*c* for color printing as lubricant when carrying out monochrome printing does not overlap with the toner remaining on photoreceptors 3*a*, 3*b*, and 3*c* for color printing when carrying out color printing, and thereby reducing the consumption of the toner used for non-printing purpose.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming device, comprising:

a first photoreceptor for forming monochrome picture-image that corresponds to black toner;

a second photoreceptor for forming color picture-image that corresponds to color toner;

cleaner blades that are respectively in contact with said first and second photoreceptors;

developing devices corresponding to respective colors of the toner;

a drive mechanism for causing said first and second photoreceptors to rotate;

a picture-image forming unit for forming an image by transferring a toner image developed on said first and second photoreceptors to an image carrier;

a supplying unit for supplying the toner to said first and second photoreceptors; and a controller, wherein said drive mechanism causes said second photoreceptor to rotate when forming a monochrome picture-image using said picture-image forming unit, and said controller causes said supplying unit to supply a predetermined amount of toner as lubricant to said second photoreceptor at a timing determined based on an amount of toner remaining on said second photoreceptor after the transfer to said image carrier, wherein a first counter is provided for integrating a first toner amount obtained from the amount of operation of said picture-image forming unit for forming a monochrome image; and a second counter is provided for integrating a second toner amount obtained from the amount of operation of said picture-image forming unit for forming a color image, the second toner amount being the amount of toner remaining on said second photoreceptor, wherein at said timing at which a value obtained by subtracting a value of said second counter from a value of said first counter reaches a threshold value, said controller causes said supplying unit to supply the toner of an amount corresponding to said threshold value as lubricant to said second photoreceptor.

2. The image forming device according to claim 1, wherein said controller calculates said first toner amount by multiplying the amount of operation of said picture-image forming unit for forming a monochrome image by a unit amount of toner, and integrates said first toner amount using said first counter.

3. The image forming device according to claim 1, wherein said controller calculates said second toner amount based on the amount of operation of said picture-image forming unit for forming a color image, a printing rate of said color image, and a transfer rate from said second photoreceptor to said image carrier, and integrates said second toner amount using said second counter, said second toner amount being the amount of toner remaining on said second photoreceptor after the transfer to said image carrier.

4. The image forming device according to claim 3, wherein said controller calculates said second toner amount using the transfer rate corresponding to an environmental condition within the image forming device, said second toner amount being the amount of toner remaining on said second photoreceptor after the transfer to said image carrier.

5. The image forming device according to claim 1, wherein said second photoreceptor includes a plurality of color photoreceptors respectively corresponding to the plurality of colors of the toner, said second counter integrates each of said colors of the toner, said controller calculates said second toner amount for each color of the toner and integrates said second toner amount using the second counter for the corresponding color, said second toner amount being the amount of toner remaining on said second photoreceptor after the transfer to said image carrier, and said controller causes said supplying unit to supply the toner of said predetermined amount to one of said color photoreceptors at the timing at which the threshold value is reached, said one of the color photoreceptors having the value obtained by subtracting corresponding one of the values of said second counter from the value of said first counter reaches said threshold value.

6. The image forming device according to claim 1, wherein said second photoreceptor includes a plurality of color photoreceptors respectively corresponding to the plurality of colors of the toner, said second counter integrates each of said colors of the toner, said controller calculates said second toner amount for each color of the toner and integrates said second toner amount using the second counter for the corresponding color, said second toner amount being the amount of toner remaining on said second photoreceptor after the transfer to said image carrier, and said controller causes said supplying unit to supply the toner of said predetermined amount to all of said color photoreceptors at the timing at which the value obtained by subtracting at least one of the values integrated by the second counter for said respective colors of the toner from the value of said first counter reaches the threshold value.

7. The image forming device according to claim 1, wherein said controller sets the value obtained by subtracting the value of said second counter from the value of said first counter to 0 when the value of said second counter is greater than the value of said first counter.

8. The image forming device according to claim 1, wherein said controller causes said supplying unit to supply the predetermined amount of toner in a period between one image forming operation and a subsequent image forming operation by said picture-image forming unit during which an image forming operation is not carried out, wherein said controller sets the period by extending an interval between the image forming operations.

9. The image forming device according to claim 1, wherein said controller causes said supplying unit to supply the predetermined amount of toner in a period during which an image forming operation by said picture-image forming unit is not carried out, wherein said controller sets the period by temporarily stopping said image forming operation.

* * * * *